US007310892B1

(12) United States Patent
Cate et al.

(10) Patent No.: US 7,310,892 B1
(45) Date of Patent: Dec. 25, 2007

(54) METHOD OF PRODUCING A SOIL ENRICHMENT PRODUCT FROM DEWATERED SLUDGE

(75) Inventors: Paul C. Cate, Chattanooga, TN (US); Gary M. Cosby, Signal Mountain, TN (US)

(73) Assignee: Consolidated Technologies, Inc., Chattanooga, TN (US)

( * ) Notice: Subject to any disclaimer, the term of this patent is extended or adjusted under 35 U.S.C. 154(b) by 236 days.

(21) Appl. No.: 10/917,546

(22) Filed: Aug. 12, 2004

Related U.S. Application Data

(60) Provisional application No. 60/505,084, filed on Sep. 23, 2003.

(51) Int. Cl.
*F26B 5/04* (2006.01)

(52) U.S. Cl. ..... 34/408

(58) Field of Classification Search ..... 34/406, 34/407, 408, 361, 363, 381; 210/742; 204/252
See application file for complete search history.

(56) References Cited

U.S. PATENT DOCUMENTS

| | | | | |
|---|---|---|---|---|
| 3,802,089 | A * | 4/1974 | Stephanoff | 34/327 |
| 4,013,516 | A * | 3/1977 | Greenfield et al. | 201/2.5 |
| 5,681,481 | A * | 10/1997 | Christy et al. | 210/723 |
| 5,741,465 | A * | 4/1998 | Gregg | 422/189 |
| 2003/0136747 | A1* | 7/2003 | Wood et al. | 210/774 |

* cited by examiner

*Primary Examiner*—S. Gravini
(74) *Attorney, Agent, or Firm*—Stephen J. Stark; Miller & Martin PLLC

(57) ABSTRACT

A method of pasteurizing dewatered sludge into valuable soil conditioners is provided. Unpasteurized dewatered sludge is introduced into a first end of an dryer and maintained under vacuum pressure. Moisture is removed using a condenser and knock out tank while a boiler provides heat to treat the dewatered sludge. An auger moves the sludge to an outlet.

19 Claims, 4 Drawing Sheets

METHOD OF PRODUCING A SOIL ENRICHMENT PRODUCT FROM DEWATERED SLUDGE

CLAIM OF PRIORITY

This application claims the benefit of U.S. Provisional Patent Application No. 60/505,084 filed Sep. 23, 2003.

BACKGROUND OF THE INVENTION

1. Field of the Invention

This invention relates to a method of producing a soil enrichment product from dewatered sludge utilizing a vacuum-auger dryer.

2. Brief Description of the Related Art

Vacuum-auger dryers have appeared in at least two references: U.S. Pat. No. 4,753,016 and U.S. Pat. No. 5,570,516. U.S. Pat. No. 4,753,016 shows a condensation process and apparatus for water vapor that is under vacuum. As explained in the specification, this device appears to have been created for an industrial process such as drying plastic granules as explained in column 3, lines 40-42. U.S. Pat. No. 5,570,516 also appears to be directed to a drying system for an industrial process since the dryer is coupled to an industrial mixer as is shown illustrated in FIG. 2 and as described in the abstract.

These prior art driers apparently have industrial process applications. There has been no known effort made in the field of wastewater treatment to provide a similar method and apparatus for treating a particular by-product of wastewater treatment plants. Accordingly, a need exists to convert dewatered sludge into a soil enriching product such as a loam for fertilizer or top soil having carbon and nitrogen products that have not been reduced to ash which would not be particularly advantageous to assisting soil or grow vegetation.

In the process of treating raw wastewater, it is normally sent to primary tanks where heavier solids settle and are collected for additional treatment and/or disposal. The liquid is transferred from the tanks, aerated and aerobically treated so that the particulates settle out in the secondary settling process as sludge. The water may be removed from both primary and secondary sludges and this by-product is known as dewatered sludge. Normally this unpasteurized dewatered sludge is hauled to landfills where it takes up space. This costs municipalities a relatively large amount in transportation costs. Furthermore, it fills in a landfill which could be utilized for other waste products.

In order to reduce the costs associated with transporting dewatered sludges, it has been discovered that drier sludges have reduced transportation and disposal costs since moisture adds to the weight of the dewatered sludge. In order to remove moisture content the dewatered sludge is typically dried at a high temperature well over 250° F. At high temperatures, some of the dewatered sludge may be burned or otherwise oxidized so that the carbon components in the sludge forms an ash which provides limited, if any, soil enrichment properties. The ash also presents an offensive "burned coffee" odor and can give off particulate emissions that require air pollution controls. Nitrogen components may also be oxidized at a high temperature resulting in a loss of fertilizer value and possibly creating exhaust gasses which may require more extensive pollution controls. Furthermore, most high temperature drying processes pose hazards to operating personnel and may require special operator certification.

Accordingly, a need exists to convert the unpasteurized dewatered sludge into a useful product.

SUMMARY OF THE INVENTION

An object of the present invention is to convert unpasteurized dewatered sludge into a useful and possibly marketable soil enrichment product at lower temperatures than typical sludge dryers.

Another object of the invention is to reduce the need to ship dewatered sludge to landfills.

Another need exists to pasteurize dewatered sludge so that it may meet the highest pathogen reduction requirements (Class A) set by the federal government and thus avoid the extensive documentation process procedures currently required for lower quality sludge.

Another need exists for an improved dryer/pasteurizer for treating dewatered sludge.

Yet another need exists for an improved vacuum auger drive and process for its use as it relates to processing dewatered sludge into a useful soil enrichment product.

Accordingly, a method of pasteurizing dewatered sludge into valuable soil conditioners is provided. Unpasteurized dewatered sludge is introduced into a first end of an auger/dryer which is maintained under vacuum pressure. The vacuum is provided by a manifold connected to a knock-out tank. A condenser applies a negative pressure to the knock-out tank. Hotter fluid is passed through an a duct and then through a cooling tower where it is then pumped back in the condenser to provide a temperature gradient in the condenser. Condensate from the knock-out tank is pumped with the condensate pump out of the knock-out tank. A boiler is utilized to provide pressurized hot water to the auger/dryer to maintain the desired temperature level such as at least a 160 degrees for 20 minutes to provide the necessary time and temperature for pasteurizing the dewatered sludge to ensure that any harmful pathogens are sufficiently reduced as the auger transfers the sludge from one end of the dryer to the other.

In addition to killing harmful pathogens, the dryer portion of the process ensures that the drying portion reduces the shipping weight and volume of the dewatered sludge which is believed to be important for disposal purposes. Not only do drier sludges have reduced transportation and disposal costs, the dryer treated sludges can be directly applied by spreading on top of land with topsoil spreaders and other such equipment or incorporated into agricultural soil with minimum documentation and site restrictions.

Accordingly, the method is believed to provide a useful soil enrichment product which would otherwise require documentation and site restrictions to remove and dispose.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

The Environment Protection Agency requires that in order to be considered as "Class A" biosolid, wastewater must first be pasteurized by heating to an elevated temperature, i.e., 160 degrees Fahrenheit and maintained at that temperature for a particular time (i.e., 20 minutes). Class A sludges are considered to be environmentally safe and can be disposed of with minimal documentation and site restrictions. In many instances pasteurized sludge can be a valuable soil conditioner. It is important to remember that pasteurization is not the same as high temperature drying, which can involve burning or oxidizing into ash.

Figure 1:
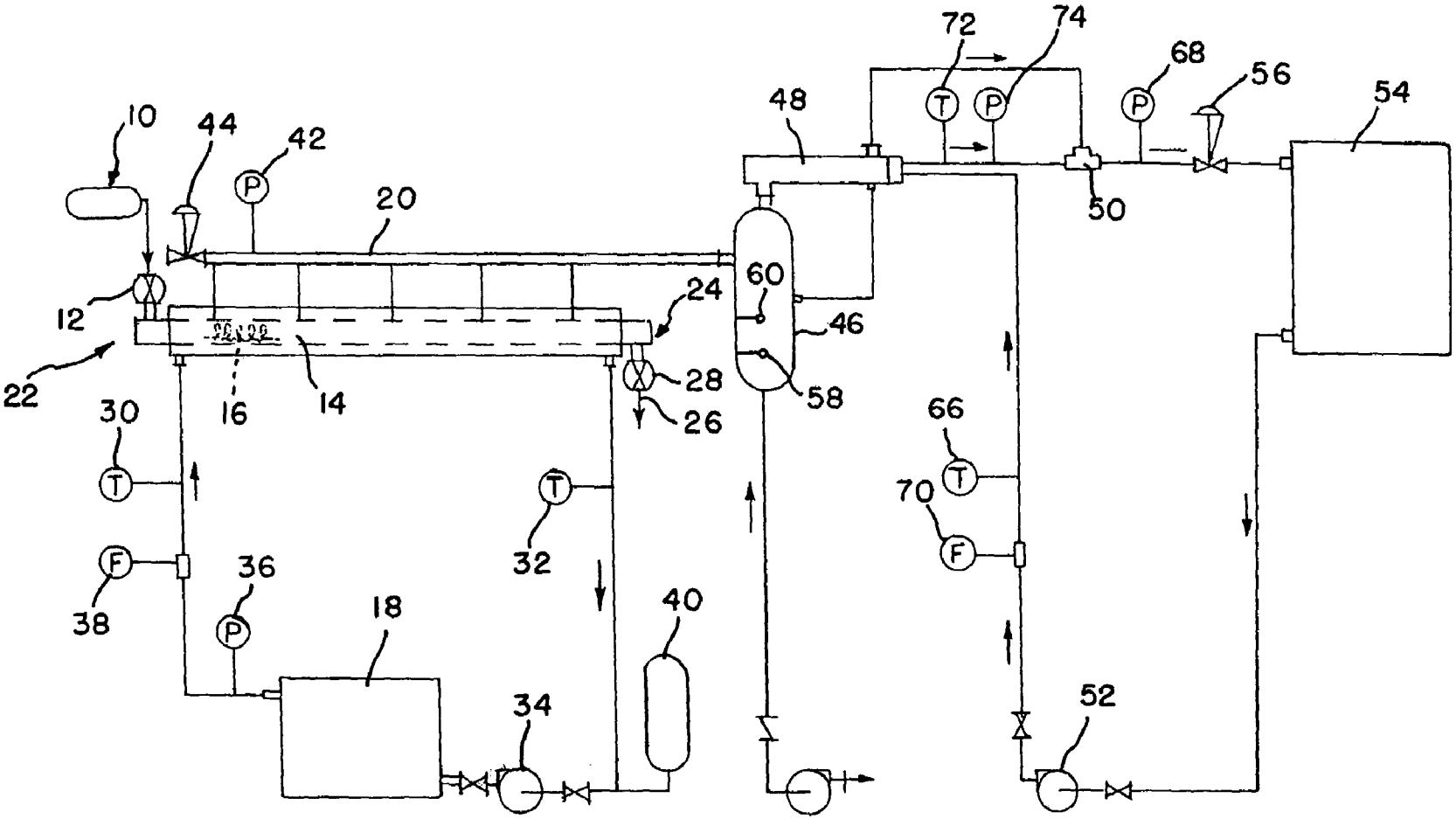
FIG. 1 is a schematic view of the components utilized to treat dewatered sludge in occurrence with the embodiment of the present invention.

As shown in FIG. 1, dewatered sludge 10 is introduced through inlet airlock 12 into a dryer 14. The dryer 14 is equipped with an auger 16, illustrated in phantom. Detailed views of the dryer 14 are better seen in FIGS. 2-5 which show details of how heat is applied from a boiler 18 as well as how a vacuum is maintained by a vacuum manifold 20.

The auger 16 is used to move product from a first end 22 to a second end 24 of the dryer 14 so that the dewatered sludge 10 in the dryer 14 is heated and then maintained at a desired temperature for a predetermined time. The time the sludge 10 is in the dryer may be dependent at least partially on the feed rate of the auger 16 through the dryer 14. At the second end of the dryer 14, dried sludge 26 is transported out of the outlet airlock 28 as shown. Temperature gauges 30,32 are useful in verifying the heat transfer within the dryer 14.

When pressurized hot water is the medium utilized to provide heat to the dryer 14, a boiler 18 is particularly useful. As pressurized hot water passes through the dryer 14, heat is transferred to the sludge 10 maintaining pasteurization temperatures and evaporating moisture from the sludge 10. The pressurized hot water is then pumped by hot water pump 34 into the boiler 18 where it is reheated and sent back into the dryer 14. Pressure and flow meters 36,38 are useful to monitor the parameters. Additionally, an expansion tank 40 is useful in maintaining desired amount of water to the boiler 18.

The vacuum manifold 20 is preferably equipped with a pressure meter 42 to measure the vacuum as well as the vacuum release valve 44 which can prevent pressure within the dryer 14 to fall below the pasteurization temperature vaporization pressure. When the vacuum is provided to the vacuum manifold 20 by a knockout tank 46, a condenser 48 may utilize an eductor 50 to draw a vacuum in the knockout tank 46. A vacuum pump may be used in lieu of the eductor to provide the required operating vacuum.

Clean water is pumped to the condenser 48 with a cooling water pump 52 so that vapor in the knockout tank 46 is condensed. The water is then pumped on through the eductor 50 which draws a vacuum through the condenser 48. Water is then sent on to the cooling tower 54 where it is cooled so that it can be pumped with the cooling water pump 52 back into the condenser 48.

A pressure regulator 56 is useful in maintaining the desired level of vacuum in the knockout tank 46. Liquid accumulates in the knockout tank 46 and high and low levels 58,60 are useful to activate condensate pump 62 to remove condensate from the knockout tank 46. A check valve 64 is also useful to ensure that no backflow occurs into the knockout tank 46. Temperature flow and pressure gauges 66,68,70,72,74 in the vacuum drawing portion of the system are useful to maintain a desired level of vacuum in the vacuum manifold 20 so that the proper level of vacuum is drawn to remove moisture from the dewatered sludge 10 as it passes through the outer dryer 14.

Figure 2:
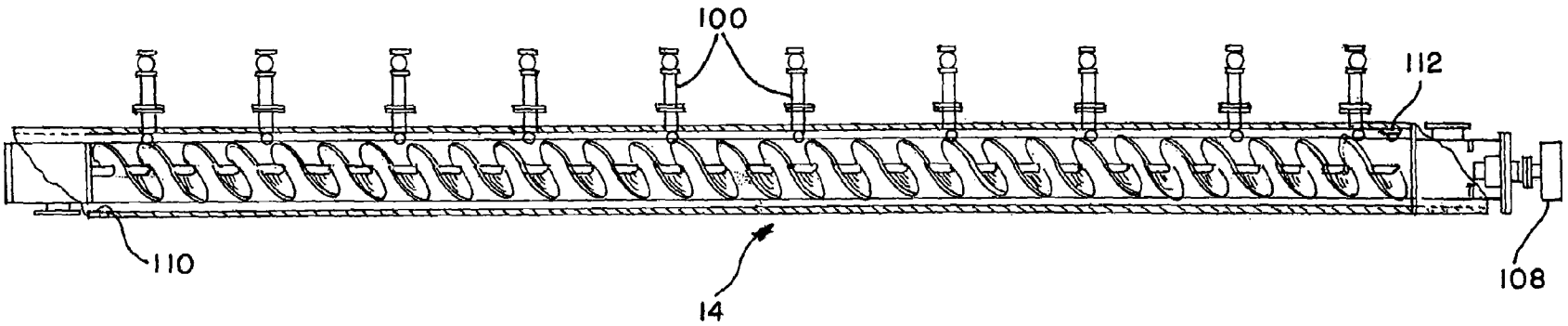
FIG. 2 is a side plan view with internal portions shown in phantom of a preferred embodiment the auger/dryer shown in FIG. 1.

FIGS. 2-5 show details of the auger dryer 14. FIG. 2 shows the auger 16 with a plurality of pipes 100 which connect to the manifold 20 shown in FIG. 1. Details of individual pipes 100 are shown best in FIG. 3 which pass through an outer shell 102 and into an inner shell 104 at thread-o-let 103 having helix 106 or auger 16 disposed therein which is driven by the driver 108 shown in FIG. 2. An outer pipe 101 receives the pipe 100 from the manifold therein. An oversized flange attached to pipe 100 is connected to a flange on pipe 101 thereby sealing the heating water gap 114 between the inner shell 104 and the outer shell 116.

The pipes 100 communicate the vacuum from the manifold 20 into the inner shell 104 to draw out moisture from the inner shell 104 which has sludge 10 therein during the drying process. Pressurized hot water is provided into inlet 110 shown in FIGS. 2 and 5 and spent pressurized hot water is removed from outlet 112 shown in FIG. 2. Pressurized hot water enters the gap 114 intermediate the inner shell 104 and the wall of the outer tube 102. The outer tube 102 has a layer of insulation 118 covered by an outer shell 102. The insulation 118 assists in reducing the heat load to perform pasteurization and the drying functions. A helix structure 115 is located in a gap 114 which is believed to assist heat transfer from the pressurized hot water to the dewatered sludge in the inner shell 104.

Figure 3:
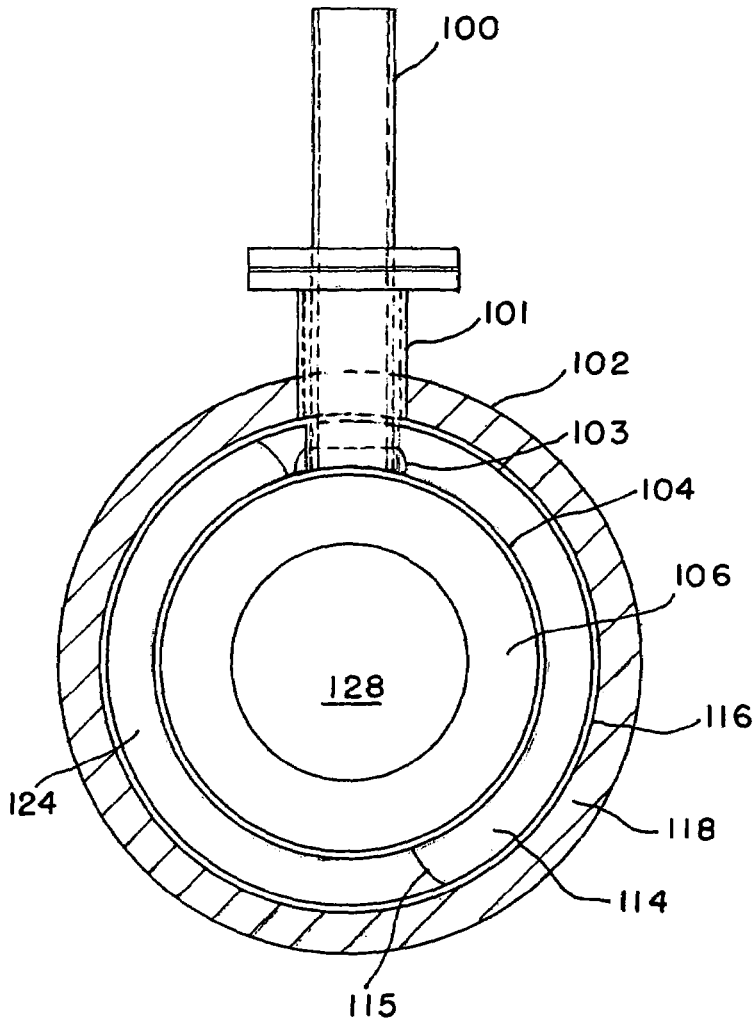
FIG. 3 is a cross-sectional view of the auger/dryer shown in FIG. 2.
Figure 4:
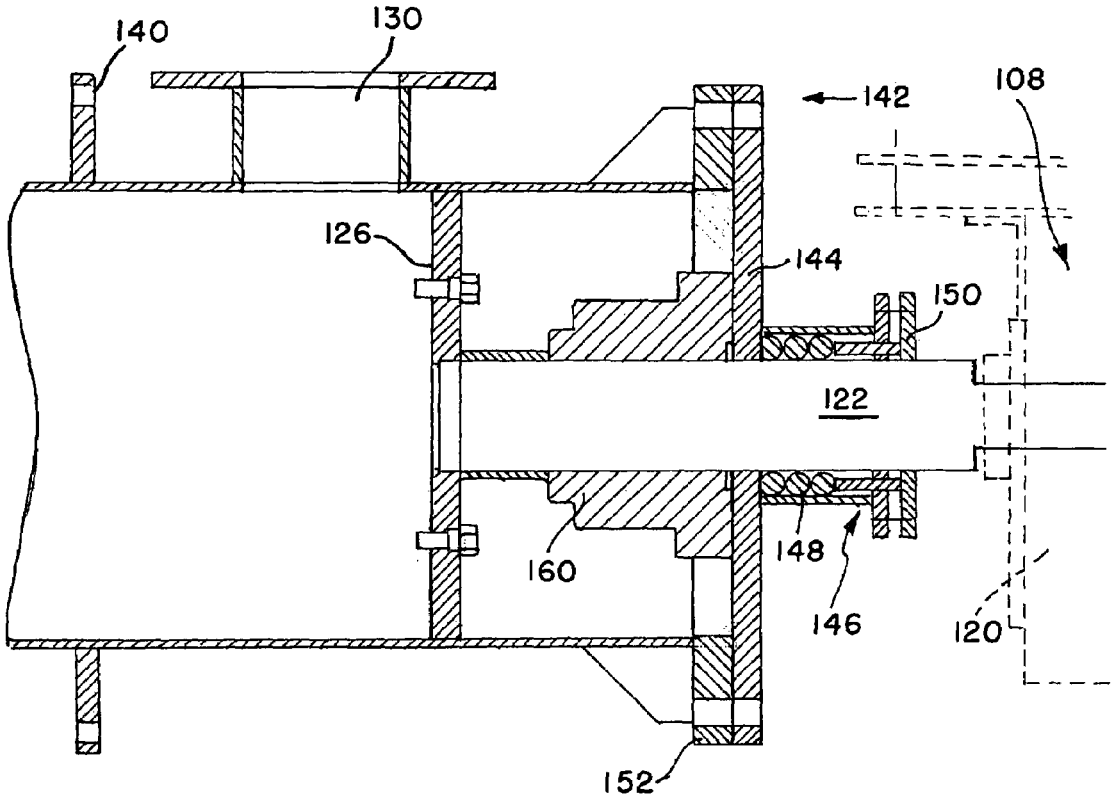
FIG. 4 is a detailed, cut-away plan view of the inlet end of the auger/dryer of FIG. 2.

The driver 108 shown in FIG. 4 preferably consists of a gezi-motor assembly 120 coupled to a driver shaft 122 which drives a shaftless screw conveyer 106 shown in FIG. 3 which is a helix driver or auger connected to the flange 126. Accordingly, the dewatered sludge is driven by the conveyer 106 or auger about its circumference while the interior 128 of the inner shell remains unobscured so that dewatered sludge 10 may pass from the top to the bottom while being rotated about the energy by the driver 108. The shaftless nature of the auger is believed to differ from prior art structure.

FIG. 4 also shows a mounting flange 140 for use in connecting the outer shell 102 to the inner shell 104. The drive shaft 122 is shown proceeding through a cap plate 144 having a seal retainer 146 which maintains a seal 148. Seal adjustment 150 is also provided. Opposite the cap plate 144 from the seal retainer 146 is a flange bearing 160. A body flange 152 is shown illustrated connected to the cap plate 144.

Once the dewatered sludge 10 proceeds to outlet 132 (FIG. 5), it is then transferred to the outlet air lock 28. The sludge 10 is preferably pasteurized at this point and is now a finished product or may be further processed. Meanwhile, dewatered sludge continues to enter through inlet 130 to provide a relatively continuous process. Further details of the preferred embodiment can be observed through viewing the specific figures of the dryer/auger as shown in FIGS. 2-5.

Figure 5:
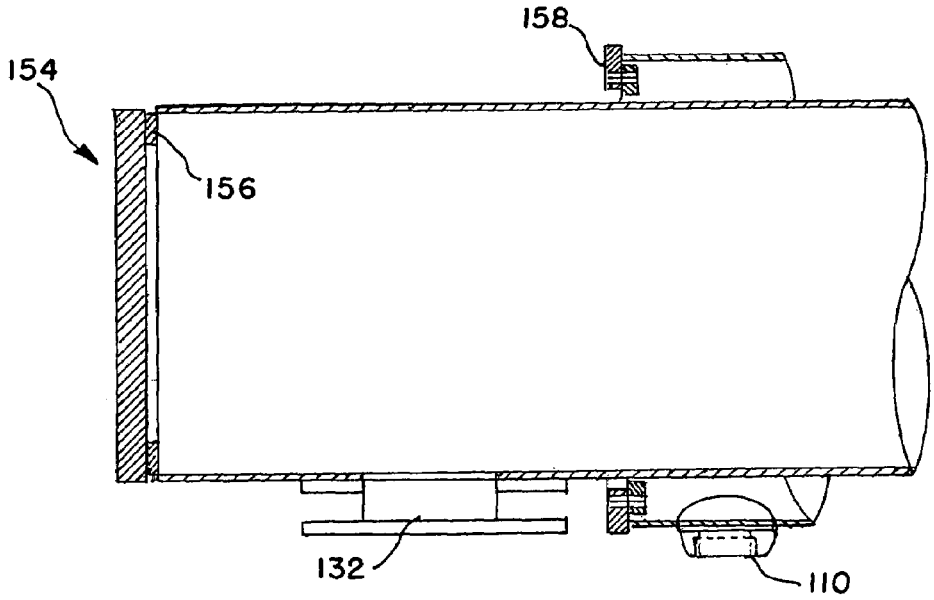
FIG. 5 is a detailed plan view of the outlet end of the auger/dryer of FIG. 2.

Details of the sludge outlet are shown in FIG. 5. The outlet end has an end plate 154 which connects to mounting ring 156 which is connected to the inner shell 104.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method for producing a soil enrichment product comprising:

providing a supply of wastewater dewatered sludge having a solid content of at least about sixteen percent;

introducing the supply of wastewater dewatered sludge into a dryer, wherein the dryer heats the dewatered sludge under a vacuum pressure for a predetermined time pasteurizing the dewatered sludge to provide a pasteurized sludge;

removing the pasteurized sludge from the dryer and providing as a soil enrichment product.

2. The method of claim 1 wherein the dryer is connected to a vacuum manifold having at least one pressure sensor measuring vacuum pressure during the step of pasteurizing the dewatered sludge.

3. The method of claim 1 further comprising a knock out tank, said knock out tank assisting in drawing a vacuum in the dryer during the step of pasteurizing the dewatered sludge.

4. The method of claim 3 further comprising a condenser connected to the knock out tank, said condenser operable to reduce the pressure in at least one of the dryer and the knock out tank during the step of pasteurizing the dewatered sludge.

5. The method of claim 4 wherein at least one of the condenser and the knock out tank collect moisture in the form of cooled condensed water from the dryer during the step of pasteurizing the dewatered sludge.

6. The method of claim 5 wherein at least some of the moisture collected is generated by the step of heating the dewatered sludge in the dryer thereby evaporating at least some water in the dewatered sludge, and then condensing the moisture to condensed water by the condenser.

7. The method of claim 5 further comprising a condensate pump and at least selectively discharging the condensed water from at least one of the condenser and the knock out tank.

8. The method of claim 1 wherein the dryer elevates the temperature of the dewatered sludge with a fluid of pressurized heated water during the step of pasteurizing the dewatered sludge.

9. The method of claim 8 further comprising a boiler which provides the fluid to the dryer at an fluid inlet, said dryer having fluid outlet, and the fluid outlet directing the fluid to the boiler to then be provided to the fluid inlet to provide heat during the step of heating the dewatered sludge in the dryer.

10. The method of claim 1 further comprising the step of transporting at least some of the dewatered sludge from an inlet to an outlet of the dryer during the step of pasteurizing the dewatered sludge before removing the at least a portion of the pasteurized sludge from the dryer.

11. The method of claim 1 wherein during the step of heating the dewatered sludge, the dewatered sludge is mechanically moved from an inlet to an outlet of the dryer as it is pasteurized.

12. The method of claim 11 further comprising an auger, and during the movement of the dewatered sludge from the inlet to the outlet, the dewatered sludge is transported about the auger.

13. A method of removing moisture from dewatered sludge comprising:

providing a supply of wastewater dewatered sludge;

introducing the supply of wastewater dewatered sludge into a dryer, wherein the dryer heats the dewatered sludge under a vacuum pressure with moisture pulled from the dryer thereby providing a pasteurized treated sludge;

removing the treated sludge from the dryer and providing as a soil enrichment product.

14. The method of claim 13 further comprising a condenser connected to the dryer wherein the condenser assists in drawing a vacuum to provide the vacuum pressure in the dryer, and further comprising the step of condensing moisture pulled from the dryer at the condenser as condensed water.

15. The method of claim 14 further comprising a condensate pump and a knock out tank and further comprising the step of selectively operating the condensate pump to remove condensed water from the knock out tank.

16. The method of claim 13 further comprising the step of providing heated fluid to the dryer to act as a heat source to heat the dewatered sludge during the step of heating the dewatered sludge.

17. The method of claim 13 further comprising the step of providing dewatered sludge at an inlet of the dryer, transporting the dewatered sludge through the dryer during the step of heating the sludge, and then removing the treated sludge from an outlet.

18. The method of claim 17 further comprising the step of rotating an auger to transport the dewatered sludge from the inlet to the outlet of the dryer.

19. A method of removing moisture from dewatered sludge comprising:

providing a supply of wastewater dewatered sludge;

introducing the supply of wastewater dewatered sludge into an inlet of a dryer, and then transporting the dewatered sludge from an inlet to an outlet the dryer while heating the dewatered sludge under vacuum pressure with moisture pulled from the dryer thereby providing a treated sludge to the outlet of the dryer, wherein the dewatered sludge is introduced to the dryer through a first air lock at the inlet and removed through a second air lock at the outlet; and removing the treated sludge from the dryer and providing as a soil enrichment product.

* * * * *